United States Patent [19]

Alvey

[11] 4,211,219

[45] Jul. 8, 1980

[54] PREVENTIVE MEDICAL BODY BRACE FOR A PERSON LIFTING OR CARRYING WEIGHTS

[76] Inventor: Frank B. Alvey, 1215 Garvin Pl., Louisville, Ky. 40203

[21] Appl. No.: 873,379

[22] Filed: Jan. 30, 1978

[51] Int. Cl.[2] ..... A61F 5/24; B43L 15/00; A45C 1/04; A45F 3/00

[52] U.S. Cl. ..... 128/95; 248/118.3; 224/101

[58] Field of Search ..... 248/118, 118.1, 118.3, 248/118.5, 102, 231; 297/394, 411; 224/5 R, 5 M, 5 N, 5 MA, 5 P, 5 Q, 5 MC, 5 T; 272/143; 273/DIG. 19; 128/95

[56] References Cited

U.S. PATENT DOCUMENTS

| | | | |
|---|---|---|---|
| 46,365 | 2/1865 | Kinman | 224/5 MC |
| 1,696,509 | 12/1928 | Tresner | 224/5 Q |
| 2,474,050 | 6/1949 | Harris | 248/118 |
| 2,539,242 | 1/1951 | Foss | 224/5 Q |
| 2,707,071 | 4/1955 | Adams | 248/118 |
| 2,827,908 | 3/1958 | Lee | 224/5 MA |

FOREIGN PATENT DOCUMENTS

| | | | |
|---|---|---|---|
| 453184 | 9/1936 | United Kingdom | 224/5 M |

*Primary Examiner*—Robert W. Michell
*Assistant Examiner*—C. W. Shedd
*Attorney, Agent, or Firm*—Price and Caslin

[57] ABSTRACT

This invention is a device that, in effect, extends the pelvic bones to support the load-bearing of a person or to carry other loads applied to the suprapelvic structure and therefore to reduce forces resultant on the lumbosacral area by transmitting part of the load through the device to the pelvic and infrapelvic structures and then to the floor. A heavy belt is shown around a person's waist which supports a pair of brace or support members mounted thereon. Each brace or support member is shown positioned at the person's side so as to be in operative relation with the pelvic girdle. Each of the brace or support members serves as a rest for the adjacent elbow of a person when a weight is being lifted or carried by the hands.

1 Claim, 4 Drawing Figures

PREVENTIVE MEDICAL BODY BRACE FOR A PERSON LIFTING OR CARRYING WEIGHTS

BACKGROUND OF THE INVENTION

1. Field of the Invention

This invention relates to a body brace to be worn by a person for assisting in lifting, or carrying weights, so that the weight will be distributed at least partially through the infrapelvic structure and through the person's lower body.

2. Description of the Prior Art

The following prior art patents have been noted.

| U.S. PAT. NO. | INVENTOR | DATE | CLASS |
|---|---|---|---|
| 322,123 | Walton | 12-8-1885 | |
| 1,451,732 | Hipwood | 4-17-23 | |
| 1,469,285 | Thompson | 10-2-23 | |
| 1,555,122 | Kelly | 1925 | |
| 1,722,205 | Freund | 1929 | |
| 2,707,071 | Adams | 1955 | 224/5 |
| 3,090,984 | Dunnigan | 1963 | 15/235.4 |
| 3,106,037 | Harkey | 1963 | 45/59 |
| 3,191,826 | Adams | 963 | 224/5 |

The Walton U.S. Pat. No. 332,123, showed a tobacco stick carrier supported across a person's chest by both a neck strap and a belt around the waist. Note, however, that the spinal column would carry much of this load.

The Hipwood U.S. Pat. No. 1,451,732 shows a fisherman with a special belt, having a front body bearing plate fitted with a pivoted socket for receiving the handle of a fishing rod therein.

The Thompson U.S. Pat. No. 1,469,285 shows a hunter with a special belt that is buckled in the back. The belt has a front gun rest of fibrous and leather material. The gun rest has a curved seat for receiving the stock of a rifle or shotgun.

The Kelly U.S. Pat. No. 1,555,122, shows a farmworker, such as a cotton picker, with a back brace that supports the upper body of the worker when he is in a stooping positive. The entire weight of the upper body is transferred to the knees and legs and the muscles of the back are relieved of strain while the arms are left free to perform the required work.

Freund, in U.S. Pat. No. 1,722,205, shows a person wearing a back support or girdle comprising a belt resiliently supporting a pair of underarm crutch members that are held upright by a chest strap.

Adams, in U.S. Pat. No. 2,707,071, shows a person with a tubular member strapped to the inner side of his forearm for holding his arms spaced outwardly from the person's body. This spaces the arms outwardly so that the luggage will not engage and interfere with walking.

Dunnigan, in U.S. Pat. No. 3,090,984, shows a person wearing a chest harness, comprising a belt and a pair of shoulder straps. The belt has a pair of front hooks that support the front of an overhead implement such as an overhead plaster darby board.

The principal objects of the present invention is to provide a body brace, support or prosthetic member for a person lifting or carrying weights. The brace, support or prosthesis is in operative relation with the hip bone or pelvic girdle and, in effect, becomes an extension of the pelvic girdle to support the weights by means of the elbow and to distribute the force of the weight through the pelvic structure and through the lower body portion while reducing the weight transferred through the suprapelvic structure and specifically through the spinal column.

A further object of the present invention is to provide a body brace of the class described with an adjustable brace member that serves as a rest for each elbow so as to connect the elbow joint to the pelvic girdle and thereby transfer part of the lifting force of the weights through the forearm bones to the pelvis through the brace member and thence through the legs to the floor, thus reducing the load on the spinal column and on the lumbosacral joints.

The present invention relates to a body brace, support or prosthesis, comprising at least one brace member that is positioned at a person's side. Means are provided to attach the brace member to the person either by means of a belt or other structure around the waist or by a strap in the area of the elbow. The brace member serves as a rest for the elbow with respect to the pelvic girdle to assist in lifting and supporting heavy weights and thereby taking the strain off the person's lumbosacral joints. The invention is a device that, in effect, extends the pelvic girdle to support the load bearing arms or to carry other loads applied to the suprapelvic structures and thereby to reduce forces resultant on the lumbosacral area by transmitting part of the load through the device to the pelvic and infrapelvic structures and thence to the floor.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENT

Figure 1:
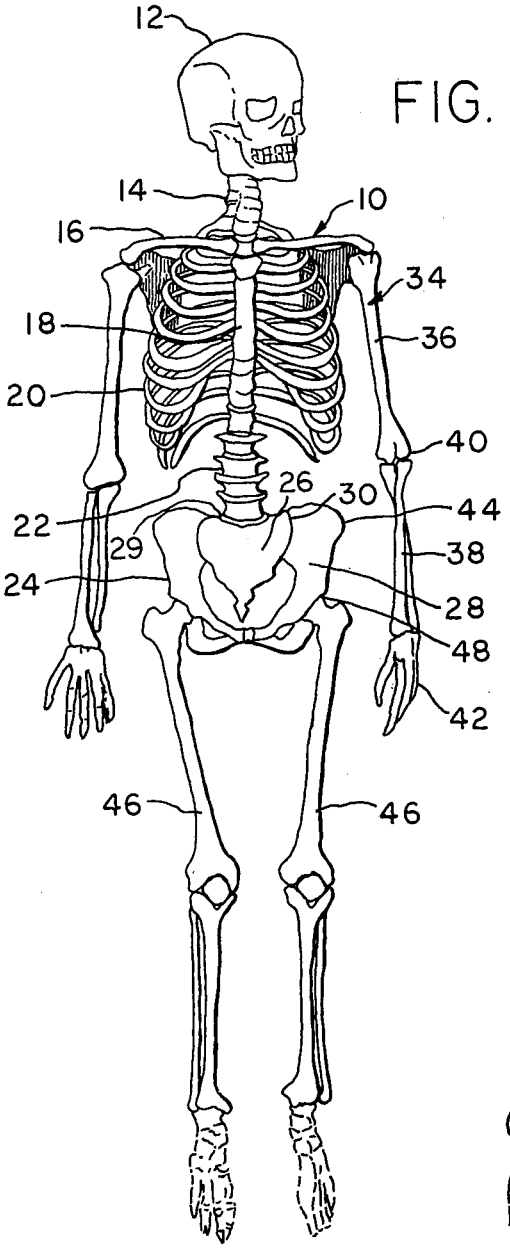
FIG. 1 is a front view of a skeleton of a human adult, having more than 200 bones. This shows that the lower half of the body is the strongest for lifting weights rather than transferring the weight up the arms, through the shoulders and related bony structures, down through the spinal column to the lumbosacral junction and from there through the larger bones of the pelvis and hips to the legs and finally to the floor.

Turning now to a consideration of the drawings, and in particular to the front view of the human skeleton 10 of FIG. 1, there is shown the head or skull 12, the neck or cervical vertebrae 14, shoulder and clavicle 16, spinal column 18, rib cage 20, lower back and lumbar vertebrae 22 the pelvis, comprising the sacrum 26 and the hip bone or ilium 28 and the lumbosacral joint 29. Connected to the shoulder 16 is the arm 34, having an upper arm or humerus bone 36 joined to a forearm 38, elbow 40 and finally a hand 42. The hip bone 28 has an ilium crest 44 at its upper side which can act as a natural shelf or ledge. The leg 46 is connected to the hip bone at the hip socket 48.

A common problem in medicine is low back pain, frequently at the lumbosacral joint 29 or the sacroiliac joint 30, which pain is induced by low back strain or most serious pathology. Among other causes for this condition is acute or chronic trauma inflicted on the lumbosacral and sacroiliac structures by the forces present during lifting or supporting of objects. Such lifting-induced trauma is of particular concern in occupational health or medicine where the workplace becomes the occasion for such trauma induced by repetitive lifting and carrying motions. This invention will reduce the lifting forces on the low back, by partial force transfer to the infrapelvic structures through the body brace. Thus, this is a preventive medical device.

When an object is lifted by a person in a standing position, even using correct lifting procedures of legs apart, knee bending, and no back bending, the weight of the object is transferred up the arms 34, through the shoulders 16 and related bony structures, down the spinal column 18 to the lumbosacral junction 29 and then through the sacroiliac joint 30 to the larger pelvic bones 24 and 28 and to the legs 46. Stiffening the upper arms 36 and the elbows 40 against one's sides during such lifting provides more stability and transferred some downward forces through the soft tissues of the abdominal structures to the pelvis 24, hips 28 and legs 46. This, however, tends to become uncomfortable after repeated lifting maneuvers, especially during raising and carrying of bulky objects. Thus, during carrying and lifting actions, the forces are transferred to the floor through a person's bony structure and must therefore pass through the weak lumbosacral joint 29, the weak sacroiliac joint 30 and other joints of the spinal column 18.

The present invention embodies a simple means to connect the elbow joint 40 to the iliac crest 44 or to the pelvic or hip bone and thereby transfer part of the forces of lifted weights to the floor by forces through the forearm 38 to the elbow 40 to the pelvis 24 and thence to the floor, thus partially sparing the spinal column 18 and the lumbosacral joints 30.

Figure 2:
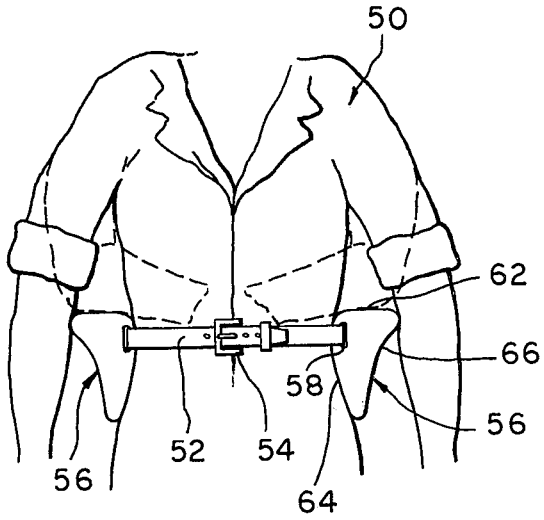
FIG. 2 is a fragmentary front view of a person wearing the body brace of the present invention around the waist with a pair of brace members positioned at opposite sides to serve as elbow rests (as shown in phantom lines) when weights are being lifted or carried.

Turning to a consideration of FIG. 2, the person 50 is shown wearing a supporting belt 52 around his waist. The belt includes a buckle 54 that fastens at the front. The belt supports a pair of brace members 56 in contact with the iliac crest 44.

Each brace member 56 in this embodiment, includes a narrow slot 58 for receiving the belt therethrough. The brace member 56 is generally triangular in front view, having a generally flat, horizontal top surface 62, a curvilinear, generally vertical body-engaging side 64 and an inclined third side, 66. Each brace member 56 is rather thick or wide so as to serve as a rest for the elbow 40 when heavy weights are being lifted or carried about. The brace member 56 may be moved to a comfortable functional position by means of the slot, slidably fixed upon the belt.

Figure 3:
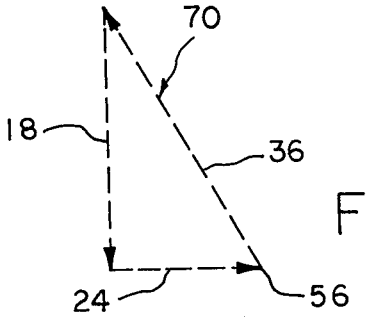
FIG. 3 is a vector diagram of forces when using the body brace of the present invention, showing an approximation of a lifting triangle for one arm with a vertical vector representing the spinal column, the horizontal vector representing the pelvis supporting one of the brace members, and the hypotenuse representing the person's upper arm (humerus bone) and shoulder.

When the elbows 40 are seated on the brace members 56, and 56, an approximated closed lifting triangle 70 is formed as is best seen in the vector diagram of FIG. 3 for one arm 34. The first side or hypotenuse vector represents the upper arm 36. The vertical vector represents the second side or spinal column 18 and the third line or third side or base line is represented by the curved pelvis 24 and brace members 56. The forearm 38 is an extension of the third side. Hence, lifting forces are transferred through this closed approximately triangular structure 70 to the floor and not solely up the arms 34 then down through the spinal column 18.

The brace member 56 is, in effect, a simple extension of the curved iliac bone 28 so as to support the elbow joint 40. The brace member 56 may assume many shapes as may be dictated by the comfort of the wearer and other functional requirements. Further, the brace member 56 may be attached to the pelvic bone or ilium 28 by straps, belts or other supporting structures. A universal shape would be preferable, but individual configurations may be provided for each user. Thus, a personalized brace might employ a brace fixed on a circumferential structure at a point to comfortably contact the pelvic structure. The brace could be hinged to permit it to be moved to the side and out of the way when not in use. Further, the brace member may be molded into the supporting structure or belt in functionally appropriate areas or in its entirety.

Since the brace members 56 in the embodiment shown, are slidable on belt 52, they are adjustable to accommodate many different sizes and shapes of loads. A single brace member 56 or two such brace members, closely spaced, could be used to support the bottom of a mailbag or newpaper bag which have shoulder straps that heretofor have carried all of the loads. Further, the brace or brace-supporting belt could be fitted with an attachment to connect to a counter attachment on the bag to thereby support the bag weight. In this case, the shoulder strap would be used merely to stabilize the bag on the support structures and would account for a minimum of the forces supporting the weight of the bag.

Figure 4:
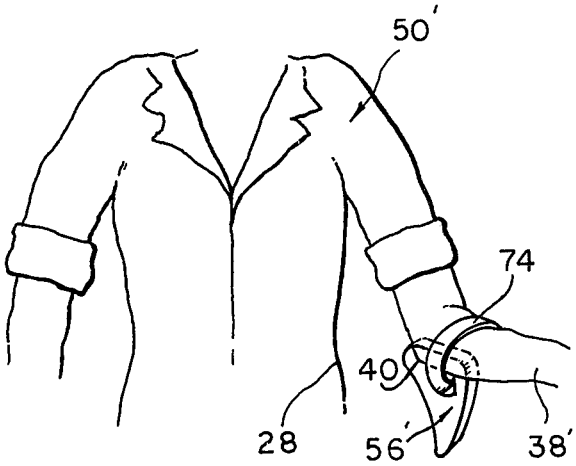
FIG. 4 is a second modification of the present invention showing a fragmentary front view of a person wearing one of the brace members on the forearm beneath the elbow rather than being strapped to the person's waist.

A modification of the present invention is shown in FIG. 4 where the person 50' has a brace member 56' strapped to the forearm 38 near the elbow joint 40 by means of strap 74. This connects the elbow 40 to the pelvis or hip bone 28 and performs in an acceptable manner to the preferred modification of FIG. 1.

A further modification of the present invention could involve partial brace members at the side and on the elbow which are brought into contact for lifting and carrying and thus achieving the embodiments contained herein. The contact point could be flat or curved.

It is also envisioned that the brace members 56 and belt 52 could be worn higher on the torso above the waist, and there would be structural members extending down to the pelvic bones, or with the lifting forces transferred to the abdominal wall musculature with extensions directly to the pelvic girdle. Modifications of this invention will occur to those skilled in this art. Therefore, it is understood that this invention is not limited to the particular embodiment disclosed, but that it is intended to cover all modifications which are within the true spirit and scope of the invention as claimed.

I claim:

1. A body brace adapted to be positioned in operative relation with the pelvic girdle of a person and to serve as a functional extension of the pelvic girdle so as to provide a load bearing rest for the elbow of the person and to assist in lifting or carrying heavy weights by increasing the forces transferred through the person's pelvic structure and reducing the forces transferred through the suprapelvic structure, which comprises:

A. a pair of braces, in which:

1. each of said brace members has a profile that is generally of a right triangle, and
2. the body engaging side of each of the brace members is curvilinear to conform to the person's body curviture in the vicinity of the waist, and,
3. the top surface of each of said base members forms a generally wide and horizontal planar surface to serve as a load bearing rest for each elbow of the person;

B. attachment means in the form of wide belt upon which both brace members are slidably mounted so that the brace members may be variably located.

* * * * *